United States Patent [19]

Zeismann et al.

[11] Patent Number: 4,932,730

[45] Date of Patent: Jun. 12, 1990

[54] REFRIGERATOR OR FREEZER WITH VENTILATION OF REFRIGERATED AREA

[75] Inventors: Hans-Peter Zeismann, Vellmar; Dieter Röser, Lohfelden; Thomas Durstewitz, Steinsfeld-Bettwar; Hans-Jürgen Führer, Gudensberg, all of Fed. Rep. of Germany

[73] Assignee: Licentia Patent-Verwaltungs GmbH, Frankfurt am Main, Fed. Rep. of Germany

[21] Appl. No.: 264,371

[22] Filed: Oct. 31, 1988

[30] Foreign Application Priority Data

Oct. 30, 1987 [DE] Fed. Rep. of Germany ... 8714435[U]

[51] Int. Cl.[5] ..... A47B 58/00

[52] U.S. Cl. ..... 312/320; 292/336.3; 292/85; 292/DIG. 63; 292/DIG. 71; 312/333

[58] Field of Search ..... 312/320, 333; 292/DIG. 71, 336.3, DIG. 16, 85, 347, DIG. 63

[56] References Cited

U.S. PATENT DOCUMENTS

| | | | |
|---|---|---|---|
| 2,872,235 | 2/1959 | Brueder | 292/336.3 |
| 3,228,746 | 1/1966 | Lundell | 312/320 |
| 4,624,490 | 11/1986 | Miller | 292/336.3 X |
| 4,707,006 | 11/1987 | Garg et al. | 292/336.3 |

FOREIGN PATENT DOCUMENTS

| | | |
|---|---|---|
| 3045599 | 7/1982 | Fed. Rep. of Germany . |
| 3119339 | 12/1982 | Fed. Rep. of Germany . |
| 3205963 | 9/1983 | Fed. Rep. of Germany . |
| 3602200 | 4/1988 | Fed. Rep. of Germany . |

*Primary Examiner*—Joseph Falk
*Attorney, Agent, or Firm*—Spencer & Frank

[57] ABSTRACT

An apparatus can be used in an appliance such as a refrigerator or freezer having a housing, a door, and a gasket for sealing the door and the housing, the housing having a contact strip, the apparatus including a handle connected to the door by two webs, the handle having a door opening member which is movably supported by the handle, the door opening member including first and second actuating latches respectively disposed adjacent each of the two webs, the first and second actuating latches each contacting the gasket for lifting a portion of the gasket away from the contact strip, wherein the door opening member can be operated to cause a reliable displacement of the actuating latches relative to the handle resulting in lifting of the gasket.

9 Claims, 2 Drawing Sheets

REFRIGERATOR OR FREEZER WITH VENTILATION OF REFRIGERATED AREA

BACKGROUND OF THE INVENTION

The present invention relates to an appliance, such as a refrigerator or freezer, having a housing and a door with a seal for sealing against a contact edge of the housing, the seal including an elastic gasket, and an adjustable door opening member having a lifting element which is in engagement with the gasket, and the door opening member being movably supported at an access opening of a handle which is connected to the door.

In a prior art refrigerator or freezer of this type, a handle equipped with a grip-through opening (i.e., a handle having a recess which accommodates a hand to facilitate opening of the door) is disposed at the door. A door opening member extends within the grip-through opening and includes an actuating latch. The actuating latch of the door opening member has a portion which engages with a region of a gasket which is fastened to the door. With the door closed, the gasket lies tightly against a contact edge of the housing of the appliance. When a user grips the handle to open the door, inserting fingers or thumb into the access opening enclosed by the handle, the displaceable door opening element is urged away from the door thereby moving the actuating latch connected therewith toward the handle. This causes the gasket to be lifted from the contact edge of the housing, thereby permitting admission of air into the interior of the housing of the appliance since air can flow in underneath the gasket to equalize the pressure between the atmosphere and the interior. The interior may have a pressure less than that of the ambient pressure due to cooling of ambient air which previously had entered the refrigerator or freezer. However, in other types of appliances which have a sealing gasket, movement of the door away from the appliance can cause flexing of the gasket itself prior to breaking of the seal, thereby equalizing the pressure of the air in the interior of the appliance with the ambient air pressure. Once the gasket seal is broken by operation of the door opening member, the pressure in the interior of the appliance is equalized, and therefore further pulling on the handle or on the door opening member requires only the force necessary to release the gasket from the contact edge. Even if in this structure the door opening member extends over the entire length of the handle, there still exists the danger that the actuating latch is not displaced sufficiently if the hand grips the door opening member at a location remote from the point of engagement of the latch. Due to necessary tolerances and unfavorable force relationships during operation of the door opening member, the door opening member and the actuating latch may be canted in their guides and the displacement of the actuating latch may be insufficient.

SUMMARY OF THE INVENTION

It is an object of the present invention to provide a door handle having a door opening member for use in an appliance such as a refrigerator or freezer having a gasket sealing the door and a contact strip on a housing of the appliance, the door opening member movably supporting a gasket lifting device such that the door opening device can be operated to cause a reliable displacement of the lifting device acting on the gasket with ordinary effort.

The above and other objects are accomplished according to the invention by the provision of an apparatus for use in an appliance such as a refrigerator or freezer having a gasket sealing the door and a contact strip on a housing of the appliance, the door opening member movably supporting a gasket lifting device such that the door opening device can be operated to cause a reliable displacement of the lifting device acting on the gasket, wherein the handle is fixed to the door by a web at either end, and wherein the door opening member is connected to an actuating latch near or adjacent to each web, for lifting the gasket.

In an appliance such as a refrigerator or freezer having a configuration according to the present invention, at least one of the actuating latches is reliably actuated by operation of the door opening member, which transmits a lifting force required for lifting the gasket away from the contact strip of the housing independently of the location of the point of attack of the door opening force. In this case, one of the actuating latches receives sufficient applied force to break the gasket seal, after which the other actuating latch is able to support the parallel guidance of the door opening member so that the gasket is lifted at two separate locations. The provision of two such actuating latches increases the operational reliability of the door opening device and permits air to flow into the interior of the appliance, e.g. a refrigerator, if subatmospheric pressure exists therein. Preferably, the door opening member is an elongated, generally straight strip which extends in a direction which is generally parallel to the handle and is which is received within in a U-shaped recess of the handle. The door opening member is movably mounted on the handle and is biased toward the door by a spring force. This permits the access opening of the handle to be kept open, and permits the door opening member to be incorporated in the structure of the handle in an ergonomically favorable manner.

BRIEF DESCRIPTION OF THE DRAWINGS

The invention will be described in greater detail below with reference to an embodiment that is illustrated in the drawings.

DESCRIPTION OF THE PREFERRED EMBODIMENT

Figure 1:
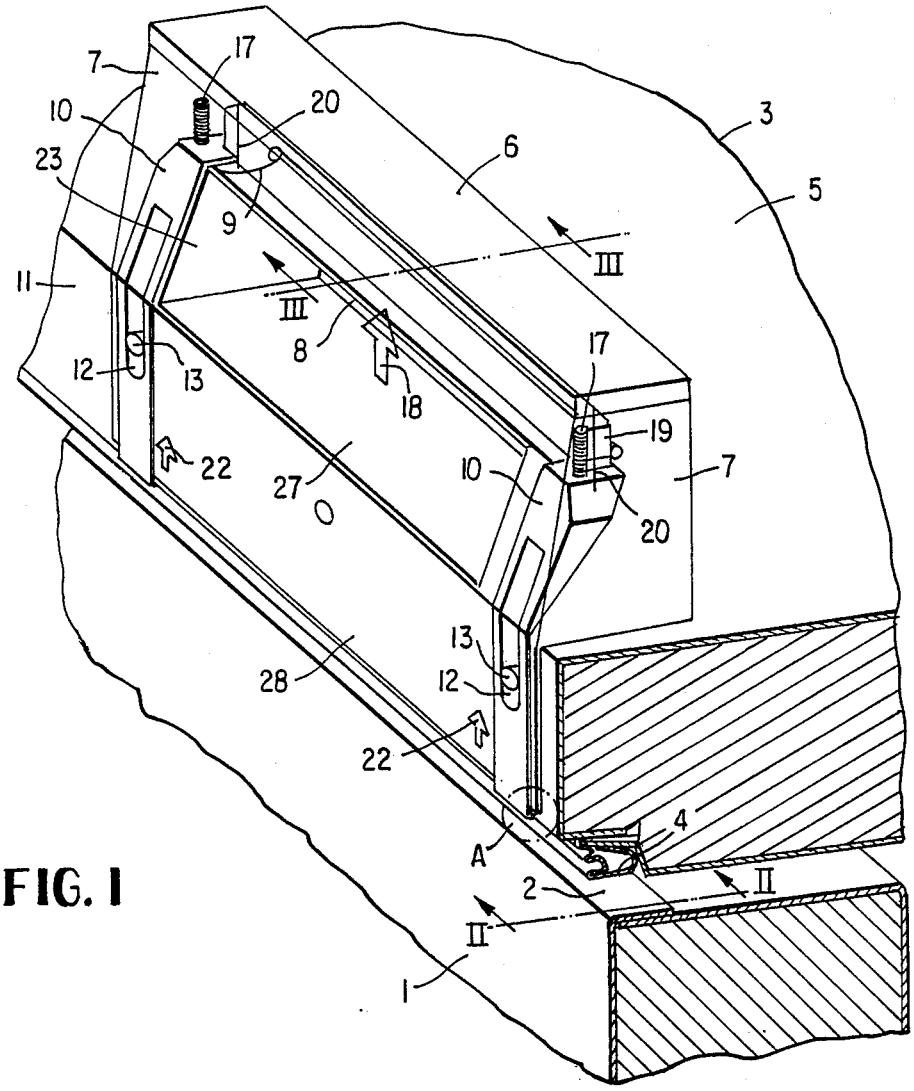
FIG. 1 is a perspective view, partially broken away and in section, of an appliance according to the invention including a door sealed to a housing by a gasket, a handle, and a door opening member connected to the door for lifting the gasket away from the housing.

A housing 1 of an appliance such as a refrigerator, freezer, or freezer chest includes a bent-over contact edge 2 for a magnetic, elastic profiled gasket 4 provided at a door 3, as shown in FIG. 1 (in this Fig., none of the lines are dashed even though they would be concealed by another part). The gasket 4 has a magnetic head 15 which is magnetically attracted to the contact edge 2. A handle 6 extends in a longitudinal direction which is generally parallel to the contact edge 2 and to the gasket 4. The handle 6 is fixedly connected to the door 3 by two webs 7 which are seated on a front wall 5 of the door 3. The handle 6, the two webs 7, and the front wall 5 enclose an access opening 8 through which the fingers of a hand can enter in order to operate the door 3 and to grip the handle 6. The handle 6 here preferably has a U-shaped cross-section (shown in FIG. 3), with the concave portion of the handle 6 being open toward the front wall 5 to receive a grip guide 19. The grip guide 19 is connected to a grip portion or door opening member 9 by a pair of screws 20, one of which is disposed at each end of the grip guide 19. The door opening member 9 is projectable into and from the access opening 8 along a path which is constrained by the grip guide 19 to follow a linear path relative to the handle 6, with the grip guide 19 being displaceable within the U-shaped cross-section of the handle 6 which is disposed in a direction which is parallel to the front wall 5.

Figure 2:
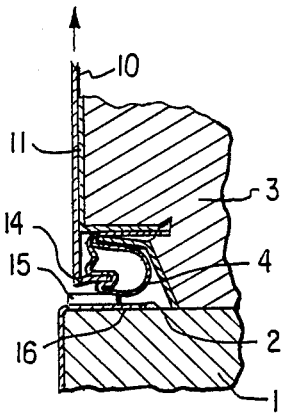
FIG. 2 is an enlarged side sectional view taken along line II—II of the region labelled "A" in FIG. 1, illustrating a gasket which is in engagement with a lifting device of the apparatus according to the invention.

The door opening member 9 extends at least across approximately all of the space between the webs 7. Two actuating latches 10 are connected to the door opening member 9, one at each end. The actuating latches 10 are preferably partially covered (not shown) by respective ones of the webs 7 and by the handle 6. The actuating latches 10 extend beyond a front wall 11 of the door 3 adjacent the gasket 4 and include a lip 14 which projects into a fold of the gasket 4, as shown in FIG. 2. The actuating latches 10 here are provided with guide slots 12 in the region of the front wall 11, with the orientation of the length of the guide slots 12 corresponding to the displacement path of the actuating latches 10 and of the door opening member 9. The guide slots 12 cooperate with stationary pins 13 to guide displacement of the actuating latches 10. As shown in FIG. 2, the lip 14 laterally engages into an expansion fold 16 of the gasket 4 adjacent the magnetic head 15. A pair of spring elements 17 are disposed between the door opening member 9 and the handle 6 to resiliently bias the door opening member away from the handle 6. The door opening member 9 can be actuated manually against the force of the spring elements 17 in the direction shown by arrows 18 and 22. The spring elements 17 are here configured as helical springs but other pressure springs, such as plate springs, may also be configured for use with the handle 6 or the door opening member 9, especially if the handle 6 or the door opening member 9 are injection molded of plastic. The force of the spring elements 17 disposed between door opening member 9 and handle 6 is directed oppositely to the actuation direction that is indicated by the arrow 18.

To remove the door 3 and the gasket 4 from the contact edge 2 of the housing 1, a user applies the fingers of one hand through the access opening 8 to grip the handle 6 and the door opening member 9. When the user's hand is closed the pressure exerted by the grip of the hand to pull open door 3 cause the fingers to displace the door opening member 9 in the direction of the arrow 18 toward the handle 6. This movement causes the coupled actuating latches 10 to pull the lip 14 away from the contact edge 2. Since each lip 14 is in engagement with the expansion fold 16 of the gasket 4, the magnetic head 15 of the gasket 4 is lifted away from the contact edge 2 in the region of the respective lip 14. If subatmospheric pressure exists in the chamber (i.e., the enclosed interior of the appliance) sealed by the door and accommodating the material to be refrigerated, pressure compensation occurs due to the air flow path created by the gap under the section of the gasket 4 lifted away from the contact edge 2. Once the pressure is equalized, further opening of the door 3 then requires the application of only that amount of force resulting from the magnetic attraction between the magnet head 15 and the contact edge 2, which is preferably formed of a flexible magnetic material such as a plastic having iron particles therein. Even if only one of the user's fingers reaches into the access opening 8 in the region of one of the webs 7 for the purpose of pulling open the door 3, secure release of one section of the gasket 4 from the contact edge 2 is realized because an actuating latch 10 is provided adjacent each of the webs 7, each of the latches 10 having a lip 14 for engaging into an expansion fold 16. The actuating latches 10 are here preferably covered by a covering portion (not shown) which is connected with the handle 6 and with the webs 7 to so as to avoid soiling of the latches 10 and to prevent inadvertent access of material between each of the pins 13 and the walls of the associated guide slot 12. This also results in an aesthetically more pleasing appearance of the handle 6 and the lifting device disposed therein which includes the door opening member 9 and the actuating latches 10. Moreover, the door opening member 9 is guided in a grip guide 19 which has associated therewith the screw 20.

Figure 3:
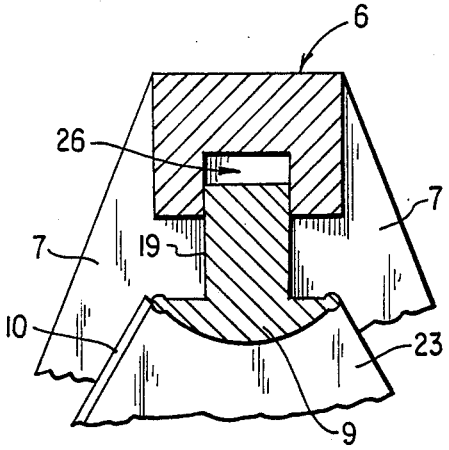
FIG. 3 is a side sectional view taken along line III—III of FIG. 1.

As shown in FIG. 3, the door opening member 9 and the handle 6 in the preferred embodiment are symmetrical about a vertical centerline. The door opening member 3 has a curved lower edge, which is visible also in FIG. 1. The grip guide 19 is received in a slot 26 which is disposed in the handle 6. While a preferred embodiment is shown of the of the guiding of the door opening member 9 relative to the handle 6, other embodiments are also contemplated. For example, the door opening member 9 can be guided in movement relative to the handle 6 by a plurality of guide pins fixed to the door 3 which pass through bores formed in the actuating latches 10. Alternatively, the grip guide 19 can be received in respective grooves or slots formed in the webs 7.

Figure 4:
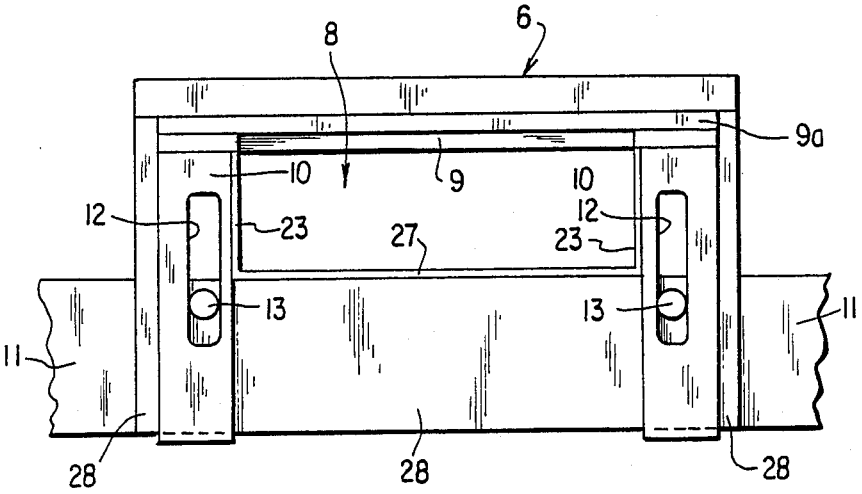
FIG. 4 is a front elevational view, broken away on either side, of the apparatus of FIG. 1.

A front elevational view of the apparatus according to the invention is shown in FIG. 4. Between the actuating latches 10 are upstanding walls 23, which are integral with a lower support wall 27. A lower plate 28, which is connected to the web 7, supports the stationary pins 13.

It will be understood that the above description of the present invention is susceptible to various modifications, changes and adaptations, and the same are intended to be comprehended within the meaning and range of equivalents of the appended claims.

What is claimed is:

1. An apparatus for use in an appliance such as a refrigerator or freezer having a housing, a door, and a gasket fixed to the door for sealing the door and the housing, the housing having a contact strip, comprising:

a handle connected to the door by two webs; said handle having a U-shaped cross-sectional configuration oriented such that the concave portion of the cross-sectional configuration is disposed toward the door, and door opening means movably supported by said handle, said door opening means including a guide portion displaceably received in said U-shaped cross-section, first and second actuating latches respectively disposed adjacent each of said two webs, said first and second actuating latches each contacting the gasket for lifting a portion of the gasket away from the contact strip, wherein said door opening means can be operated to cause a reliable displacement of said actuating latches relative to said handle resulting in lifting of the gasket.

2. An appliance as defined in claim 1, wherein said guide portion of said door opening means is a strip which extends in a direction which is generally parallel to said handle.

3. An appliance as defined in claim 2, wherein said guide portion of door opening means extends at least approximately across the space between said two webs, said door opening means further comprising connecting means disposed near each two webs for connecting said door opening member with said actuating latches.

4. An appliance as defined in claim 1, wherein said door opening means includes a grip portion disposed near said handle, and further comprising spring means disposed between a portion of said door opening means and said handle for urging said grip portion of said door opening means away from said handle such that the force exerted by said spring elements is directed against said actuating latches of said door opening means.

5. An appliance as defined in claim 4, wherein said spring means comprise a plurality of separate compression springs.

6. An appliance as defined in claim 4, wherein said spring means comprise a plurality of plate springs.

7. An appliance as defined in claim 4, wherein said spring means comprise a plurality of members shaped to engage both said handle and said door opening means.

8. An appliance as defined in claim 4, wherein said spring means comprise a plurality of members shaped to engage said handle.

9. An appliance as defined in claim 4, wherein said spring means comprise a plurality of members shaped to engage said door opening means.

* * * * *